US005331780A

United States Patent [19]

Tully

[11] Patent Number: 5,331,780

[45] Date of Patent: Jul. 26, 1994

[54] HYPERBOLIC PARABOLOID ROOF AND SIDEWALL SYSTEM

[76] Inventor: Daniel F. Tully, 110 Ellis Farm La., Melrose, Mass. 02176

[21] Appl. No.: 852,122

[22] PCT Filed: Dec. 18, 1991

[86] PCT No.: PCT/US91/09593

§ 371 Date: Apr. 20, 1992

§ 102(e) Date: Apr. 20, 1992

[87] PCT Pub. No.: WO92/11420

PCT Pub. Date: Jul. 9, 1992

[51] Int. Cl.[5] ..... E04B 7/08; E04D 1/36

[52] U.S. Cl. ..... 52/80.2; 52/81.3; 52/469; 52/483

[58] Field of Search ..... 52/80.2, 81.3, 81.2, 52/483, 653.1, 653.2, 652.1, 81.5, 81.4, 80.2, 593, 595, 81.5, 465, 469

[56] References Cited

U.S. PATENT DOCUMENTS

| | | | |
|---|---|---|---|
| 2,268,636 | 1/1942 | Becker | 52/469 |
| 2,961,478 | 11/1960 | Burns | 52/469 |
| 3,090,162 | 5/1963 | Baroni | 52/80.2 |
| 3,206,895 | 9/1965 | Ridder et al. | 52/80.2 |
| 3,380,203 | 4/1968 | Peterschmidt | 52/81.3 |
| 3,512,819 | 5/1970 | Morgan et al. | 52/469 |
| 3,653,166 | 4/1972 | Kirschen | 52/80.2 |
| 3,727,356 | 4/1973 | Appenzeller | 52/80.2 |
| 3,729,876 | 5/1973 | Kolozsvary | 52/81.4 |
| 3,958,375 | 5/1976 | Tully | 52/80.2 |
| 5,056,291 | 10/1991 | Leung | 52/81.3 |
| 5,069,008 | 12/1991 | Ellen | 52/80.2 |

*Primary Examiner*—Michael Safavi
*Attorney, Agent, or Firm*—Joseph Zallen

[57] ABSTRACT

A hyperbolic paraboloid roof structure which has in combination rectilinear panels (10) tangentially attached to a frame of beams (11) each of whose top surfaces (11*a*) is a semicircular arc or segment thereof. The panels are assembled from prefabricated rectilinear subpanels (13).

3 Claims, 4 Drawing Sheets

FIG. 4
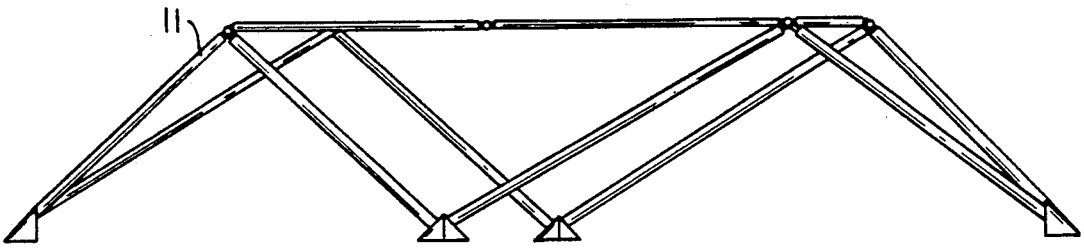
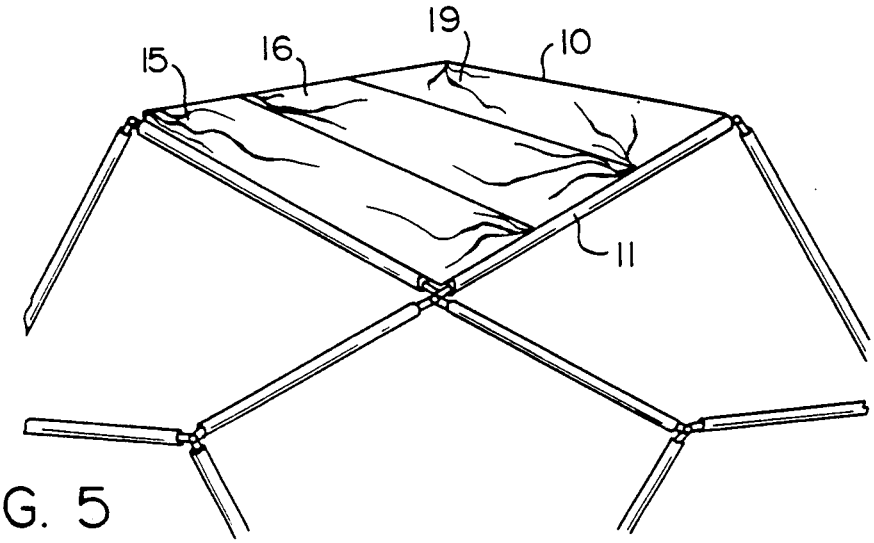
FIG. 5
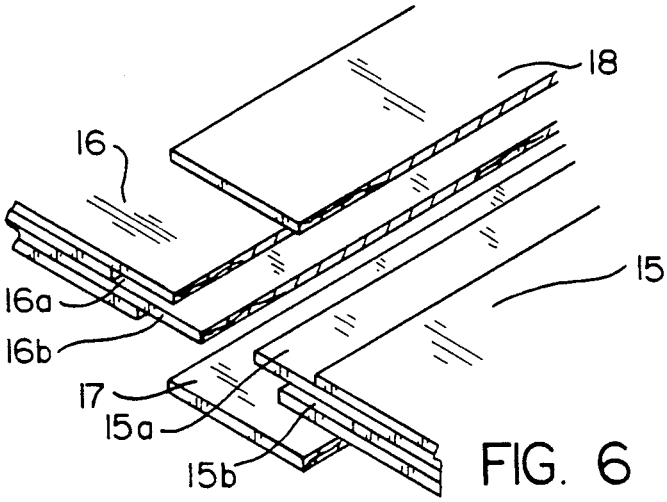
FIG. 6

HYPERBOLIC PARABOLOID ROOF AND SIDEWALL SYSTEM

BACKGROUND OF THE INVENTION

This invention relates to an improved hyperbolic paraboloid roof system.

A hyperbolic paraboloid roof is a configuration which has esthetic, structural and economic advantages for many purposes, such as inexpensive, attractive, large area structures free of intermediate columns, as for example, hangers, auditoriums and gymnasiums.

My prior U.S. Pat. No. 3,958,375 describes a hyperbolic paraboloid roof section made in prefabricated portions, each of which has a joining edge parallel to the joining edge of another prefabricated portion. The fastener means adjacent to the joining edges are provided by steel plates tied together by bolts. The present invention is an improvement on my prior patent.

Prior to my patent, hyperbolic paraboloid roof structures were customarily assembled piece by piece on the site by cutting, fitting and assembling the various portions of the roof. Thus, Peeler, U.S. Pat. No. 3,094,812, describes a precast, concrete element which in itself is flat and is assembled in multiples on steel rods or cables running through the elements both longitudinally and transversely to form a support network. Charles, U.S. Pat. No. 3,186,128, shows the construction of a hyperbolic paraboloid roof in a panel by panel construction of small sheet metal panels attached to one another, edge to edge, with waterproof joints, requiring a frame. British Pat. No. 1,019,362 (1966), describes a hyperbolic paraboloid roof which is assembled by having one layer of relatively small panels running in one direction followed by another layer of panels running in another direction. Hyperbolic paraboloid roofs have also been made by steel framing with reinforced concrete and by piece by piece assembly of wooden components.

One object of the present invention is to provide a prefabricated hyperbolic paraboloid roof section with joints which eliminate the need for bolts, shear plates and ring connectors.

Another object of this invention is to provide edge members (beams) which are universal in application, thus eliminating left or right handed beams.

Yet another object of this invention is to provide a non-metallic or non-ferrous fastening system which can be used in areas requiring a non-metallic or non-ferrous environment.

Still another object of this invention is to provide a less expensive system for constructing hyperbolic paraboloid roofs.

Further objects and advantages of this invention will be apparent from the description and claims which follow, taken together with the appended drawings.

SUMMARY OF INVENTION

The invention can be best understood by reference to a description of the principal sequence of steps for the erection of the building. The first step is the construction of concrete foundation walls and abutments. At each low working point are then installed edge beam connections at the proper location. After work points in space at proper locations and elevations have been established by the engineer, perimeter edge beams are then installed, the beams being connected to the foundation and to a portion of another beam extending from the foundation. Interior edge beams are then connected and installed. This complex of connected beams comprises the frame of the roof. The present invention is primarily concerned with the fabrication and installation of the roof sections shaped to fit and be supported by these beams. However, such sections can also be oriented so as to serve as sidewall sections. Such roof sections, are hereinafter referred to as the roof shell sections. After the roof shell sections have been installed, as hereinafter explained, a variety of finish and cover materials can be installed by conventional or previously described methods.

Where a material such as laminated wood, e.g. plywood, is used in fabricating the roof shell section, it is preferred to use at least three layers of the material. One layer runs in a different direction than other layers. Other materials which can be used include steel, fiberglass and concrete precast or formed in place.

The present invention comprises generally a roof shell section comprising rectilinear panels made of rectilinear sub-panels. The sub-panels are assembled into a panel on a frame whose beams are of uniform cross section for a particular structure and have a curved top surface, preferably a semi-circular arc or segment thereof. The edges of the panel are attached tangentially to the top surfaces of the beams. In one preferred form of the invention the panels and beams are both made of plywood. The plywood beams can vary in dimension but are typically 8 inches by 16 inches by 35 to 70 feet long, with top surfaces round or milled to a half circle.

The panels in a particular structure are preferably prefabricated and identical. In fabricating, the panels are initially formed as a plurality of sub-panels, e.g. top, middle and bottom sections so that in shipment, there can be stacks of identical top, middle and bottom sections. This allows. shipment of a large number of panels simultaneously by truck, rail, air or boat in containerized packages, thus preventing damage in shipment. The three sub-panels for each rectilinear panel are put in place consecutively, with the bottom sub-panel first using temporary supports, and are joined to form the complete rectilinear panels by preferably non-metallic means such as tongue and groove, dovetail or "Velcro" held in place by top and bottom cover plates or dowels and the like.

A preferred method for designing the form for a hyperbolic paraboloid roof shell and fabricating it is described in my U.S. Pat. No. 3,958,375. An important feature of the present invention is that the sub-panels are easier to fabricate and lighter to ship than where the entire roof section was fabricated in a large area as, for example, 1000 to 6000 square feet. In accordance with the present invention, forms can be prepared using a relatively small shaped table, as for example, 8 feet by 30 feet, with the warp built in. A section of plywood, having a minimal of three cross layers, is placed on the table and is easily depressed to the shape of the form with temporary nails or staples to hold the form in place until the applied bonding agent has set. The panels are provided with tongue and groove connections so that when they are assembled on the frame they form a properly oriented panel. Fasteners such as dowels, nails or screws or a joint cover member on one or both sides are used to lock the connection between the adjacent edges of the sub-panels.

The edges of the assembled panel are attached to the top portions of the beams and tangentially by mechanical fixtures, such as spikes, nails, screw dowels, or lag bolts.

Because of the flexibility of the system, structures can be made in many different shapes of varied span and use. The fasteners can be made of nylon, fiberglass or other reinforced plastic in place of steel bolts. The invention permits ready and rapid construction. The edge beams may be made of laminated wood or other suitable structural material such as aluminum or glass fiber reinforced resin.

BRIEF DESCRIPTION OF THE DRAWINGS

FIG. 4 is an example of a skeletal frame of a building made in accordance with this invention.

FIG. 5 is a view of a portion of a skeletal frame in which three sub-panels have been assembled to form a panel.

FIG. 6 is an isometric exploded view of a portion of the edge areas of two adjacent sub-panels which are to be assembled together.

Figure 2:
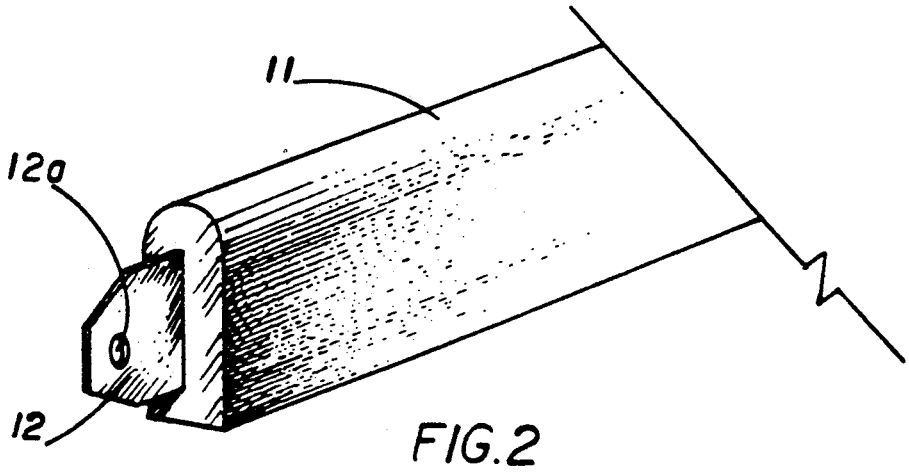
FIG. 2 is an enlargement of the end portion of FIG. 1.
Figure 3:
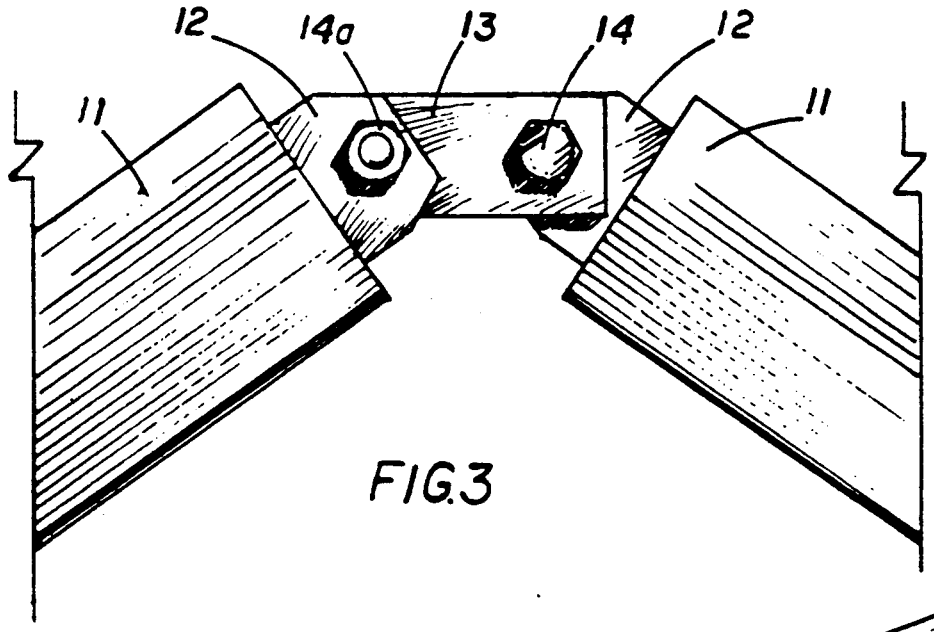
FIG. 3 is a perspective view of the end portions of two beams joined together.
Figure 1:
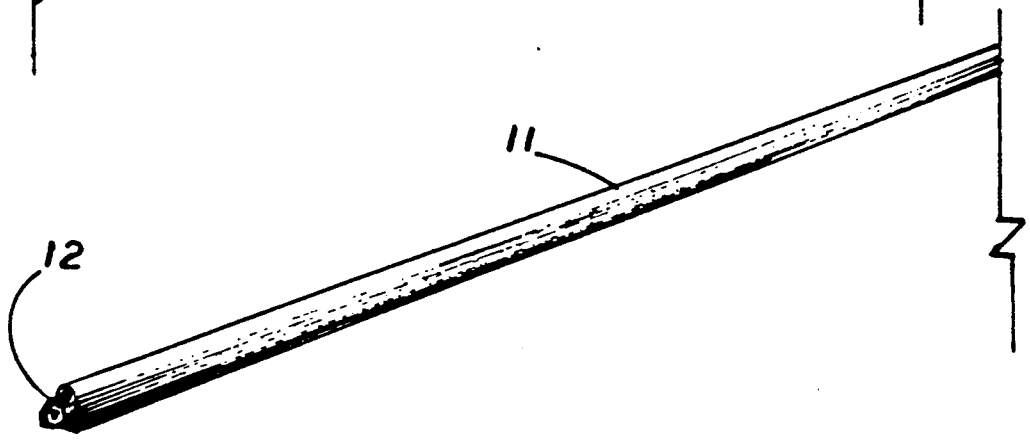
FIG. 1 is a perspective view of a portion of a beam made in accordance with this invention.
Figure 7:
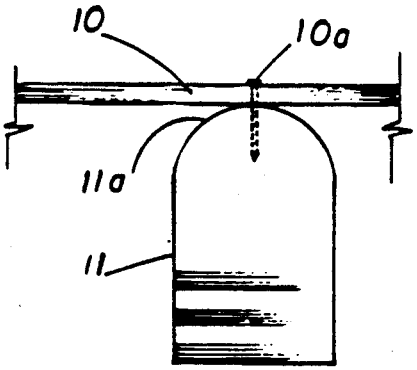
FIGS. 7 and 8 show diagrammatic cross-sections of panels attached to exterior beams.
Figure 8:
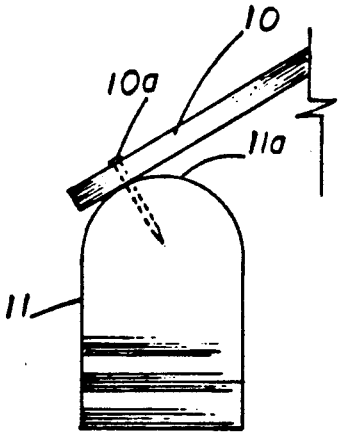
Figure 9:
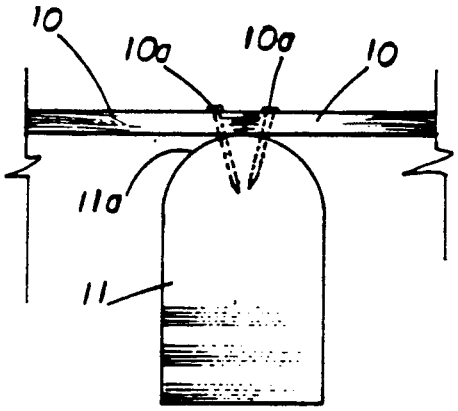
FIGS. 9 and 10 show diagrammatic cross-sections of two panels attached to interior beams.
Figure 10:
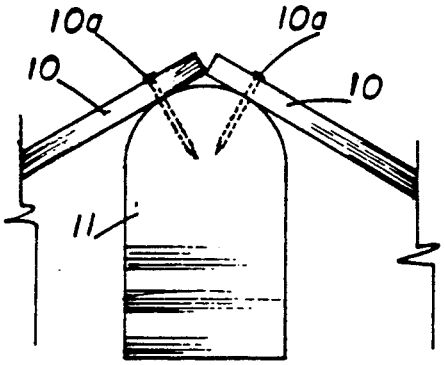
Figure 11:
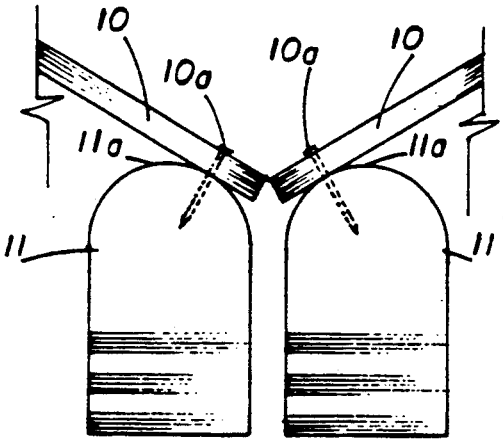
FIGS. 11, 12, and 13 show diagrammatic cross-sections of panels attached to parallel double interior beams.
Figure 12:
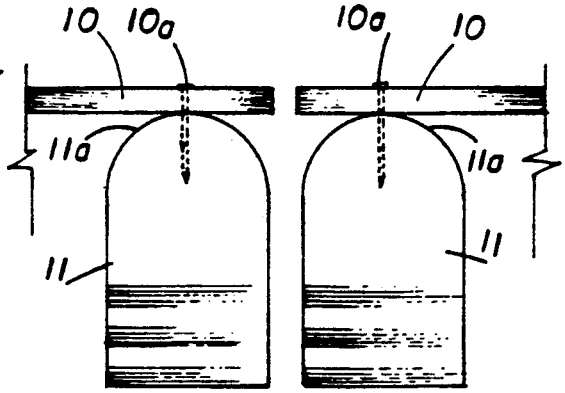
Figure 13:
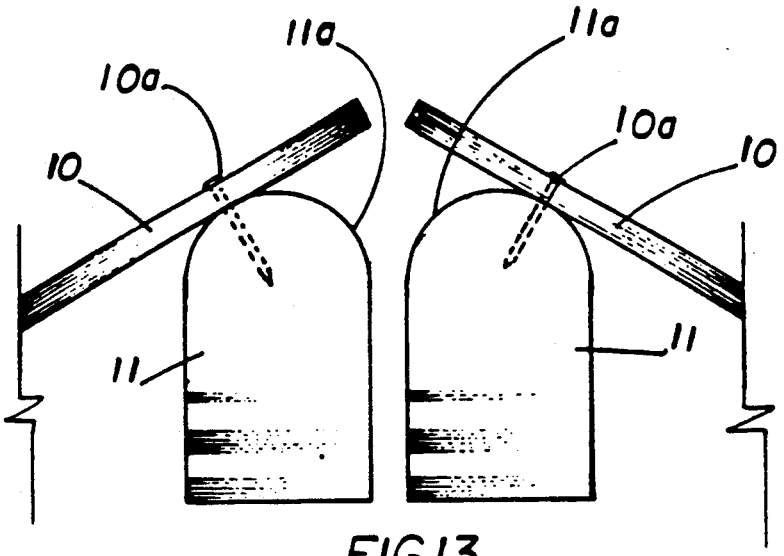

The Span Chart illustrates diagrammatically dimensions in meters of various structures which can be made in accordance with this invention.

SPECIFIC EXAMPLES OF INVENTION

Referring now to the drawings, the illustrated embodiments of this invention comprise rectilinear panels 10 assembled from sub-panels 15, 16 and 19 attached tangentially to the circular top portions 11*a* of beams 11, which are characterized as having a uniform cross-section. Beam 11 has Joining extensions 12 at each end provided with bolt holes 14*a* whereby fastening member 13 can be used with bolts 14 to fasten two beams together at a desired angle.

Adjacent sub-panels are interlocked to each other by interlocking tongues and grooves. As shown in FIG. 6 tongue 15*a* of sub-panel 15 extends into groove 16*b* of sub-panel 16, while tongue 16*a* of sub-panel 16 extends into groove 15*b* of sub-panel 15. When the sub-panels are interlocked, the attachment is made firm by the use of fasteners, as for example, nailing of top and bottom cover members 17 and 18 or by use of dowels (not illustrated) or both.

Referring now to diagrammatic FIGS. 7–13, the panels 10 are shown in various configurations attached tangentially to the upper circular portions 11*a* of the beams 11 with nails 10*a*.

Figure 14:
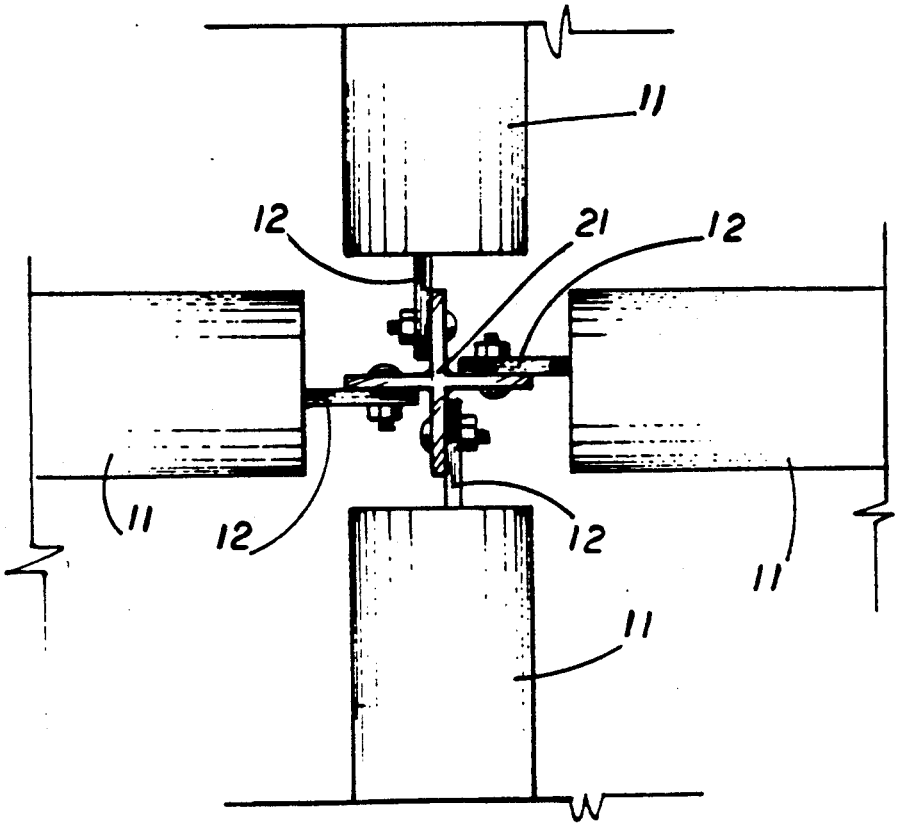
FIG. 14 shows a diagrammatic view of the joining of four beams.

As shown in FIG. 14, the joining extensions 12 of four beams 11 are attached together by bolting to a cross-plate 21.

The present invention permits a wide flexibility of design. Many configurations can be used, such as gable, umbrella, or cantilever. The sizes of structures made in accordance with this invention can vary widely from as little as 6 feet by 6 feet to spans of many hundreds of feet. Also, structures can be chained together. The invention provides maximum structural capacity with a minimum of structural material.

The Span Chart illustrates diagrammatically various plan and elevation views of modules made in accordance with this invention. The modules can vary in dimensions, and depending on their design, can be attached together to form, in some instances, structures having unlimited expansion.

I claim:

1. A hyperbolic paraboloid roof structure comprising a plurality of identical rectilinear hyperbolic paraboloid roof panels (10); each said panel (10) comprising at least three prefabricated rectilinear subpanels (15, 16, 17) arranged to interlock along abutting edges by overlapping tongue (15*a*, 16*b*) and groove (15*b*, 16*a*) means and locked together by top and bottom cover means (8); said sub-panels including a bottom (15), a middle (16), and a top (17) section of the hyperbolic paraboloidal roof panel (10); said panels being mounted on a frame made of a plurality of beams (11) having identical cross-sections and having top surfaces (11*a*) which are semi-circular arcs; the ends of the subpanels (15, 16, 17) of each panel (10) being attached tangentially by mechanical fixture means (10*a*) to said top surfaces (11*a*) of said beams (11).

2. The roof structure of claim 1 wherein said beams (11) have joining extensions permitting joining of adjacent beams (12) in a selected configuration.

3. The roof structure of claim 2 wherein said extensions are made of non-metallic material.

* * * * *